US008701940B2

(12) United States Patent
Krause et al.

(10) Patent No.: US 8,701,940 B2
(45) Date of Patent: Apr. 22, 2014

(54) APPARATUS FOR REFRIGERATOR DISPENSER RECESS INTEGRATED WITH DOOR MATERIAL

(75) Inventors: Andrew Krause, Louisville, KY (US); Justin Berger, Louisville, KY (US); Christopher Bissig, Louisville, KY (US); David Calvert, Louisville, KY (US); Bernhard Klaus, Louisville, KY (US); Robert Lewis, Louisville, KY (US); Vinayak Reddy, Louisville, KY (US); Edward Strauss, Louisville, KY (US); Jarvis Ward, Louisville, KY (US); Joseph Wimsatt, Louisville, KY (US)

(73) Assignee: General Electric Company, Schenectady, NY (US)

( * ) Notice: Subject to any disclaimer, the term of this patent is extended or adjusted under 35 U.S.C. 154(b) by 88 days.

(21) Appl. No.: 13/236,989

(22) Filed: Sep. 20, 2011

(65) Prior Publication Data

US 2013/0068793 A1 Mar. 21, 2013

(51) Int. Cl.
*B67D 7/80* (2010.01)
*F25D 3/00* (2006.01)

(52) U.S. Cl.
USPC ..... 222/146.1; 222/146.6; 222/173; 62/389; 62/391

(58) Field of Classification Search
USPC ..... 222/146.1, 146.6, 108, 173; 62/389, 62/391
See application file for complete search history.

(56) References Cited

U.S. PATENT DOCUMENTS

| | | | | |
|---|---|---|---|---|
| 2,761,288 | A * | 9/1956 | Anderson et al. | 222/108 |
| 3,640,088 | A * | 2/1972 | Jacobus et al. | 62/320 |
| 5,526,854 | A * | 6/1996 | Unger | 141/351 |
| 5,901,562 | A * | 5/1999 | Tunzi et al. | 62/229 |
| 6,658,887 | B2 * | 12/2003 | Lee et al. | 62/389 |
| 7,188,487 | B2 | 3/2007 | Choi | |
| 7,287,555 | B2 * | 10/2007 | Heger et al. | 141/86 |
| 7,415,834 | B2 * | 8/2008 | Marret et al. | 62/177 |
| 7,603,869 | B2 * | 10/2009 | Kim et al. | 62/129 |
| 7,673,471 | B2 * | 3/2010 | Egan et al. | 62/389 |
| 7,921,668 | B2 * | 4/2011 | Lee et al. | 62/389 |
| 2010/0252575 | A1 * | 10/2010 | Kim et al. | 222/146.1 |
| 2010/0293985 | A1 * | 11/2010 | Voglewede | 62/389 |
| 2013/0111941 | A1 * | 5/2013 | Yu et al. | 62/407 |

* cited by examiner

*Primary Examiner* — Kevin P Shaver
*Assistant Examiner* — Nicholas J Weiss
(74) *Attorney, Agent, or Firm* — General Electric Company; Douglas D. Zhang

(57) ABSTRACT

An apparatus includes a refrigerator door, comprising an inner door material and an outer door material, wherein a portion of the outer door material of the refrigerator is formed into a shape of a dispenser recess. The apparatus also includes a support structure, wherein the support structure is situated behind the dispenser recess of the outer door material and in front of the inner door material, and wherein the support structure facilitates implementation of one or more dispenser features. A refrigerator using the apparatus is also disclosed.

19 Claims, 18 Drawing Sheets

Section A-A

APPARATUS FOR REFRIGERATOR DISPENSER RECESS INTEGRATED WITH DOOR MATERIAL

BACKGROUND OF THE INVENTION

The subject matter disclosed herein relates generally to refrigeration, and more particularly to icemakers and the like.

It is now common practice in the art of refrigerators to provide an automatic icemaker. The icemaker is often disposed in the freezer compartment and ice is often dispensed through an opening in the access door of the freezer compartment. In this arrangement, ice is formed by freezing water with cold air in the freezer compartment.

BRIEF DESCRIPTION OF THE INVENTION

As described herein, the exemplary embodiments of the present invention overcome one or more disadvantages known in the art.

One aspect of the present invention relates to an apparatus comprising a refrigerator door, comprising an inner door material and an outer door material, wherein a portion of the outer door material of the refrigerator is formed into a shape of a dispenser recess, and a support structure, wherein the support structure is situated behind the dispenser recess of the outer door material and in front of the inner door material, and wherein the support structure facilitates implementation of one or more dispenser features.

Another aspect relates to a refrigerator comprising a body defining at least one cooled compartment, a door hinged to the body and permitting access to the at least one cooled compartment, wherein the door comprises an inner door material and an outer door material, wherein a portion of the outer door material of the refrigerator is formed into a shape of a dispenser recess, a support structure, wherein the support structure is situated behind the dispenser recess of the outer door material and in front of the inner door material, and wherein the support structure facilitates implementation of one or more dispenser features, a mold body with at least one cavity configured and dimensioned to receive water to be frozen into ice, the mold body being in thermal communication with the at least one cooled compartment, and an ice discharge mechanism, mounted to the body of the refrigerator, and configured to cause the ice to be removed from the at least one cavity and output to the dispenser recess.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
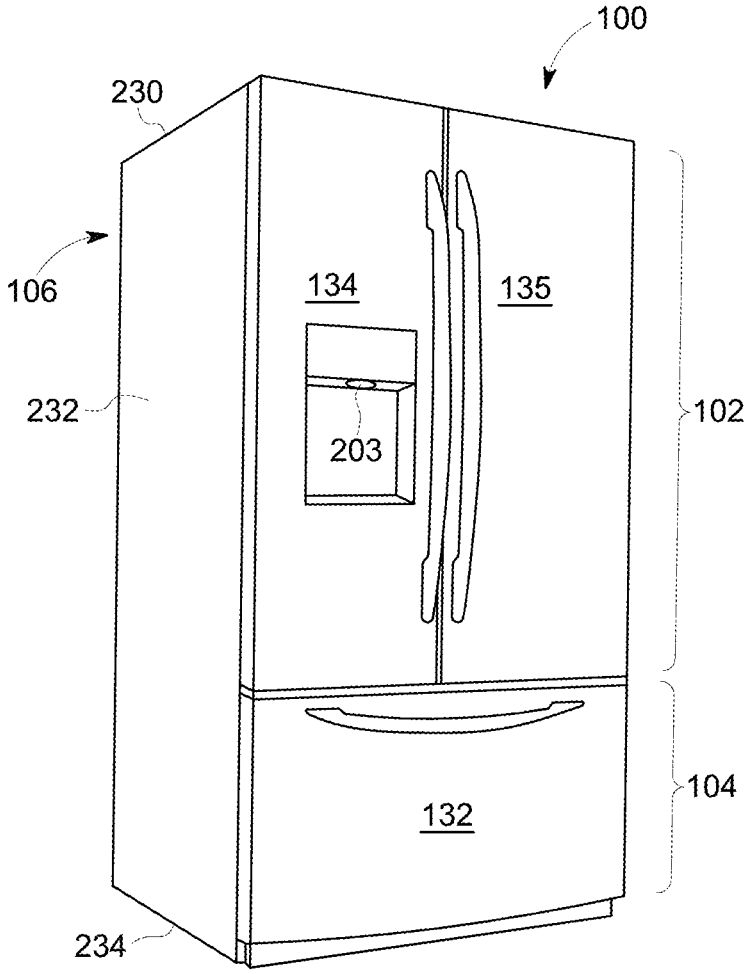
FIG. 1 is a perspective view of an exemplary "bottom freezer" refrigerator.
Figure 2:
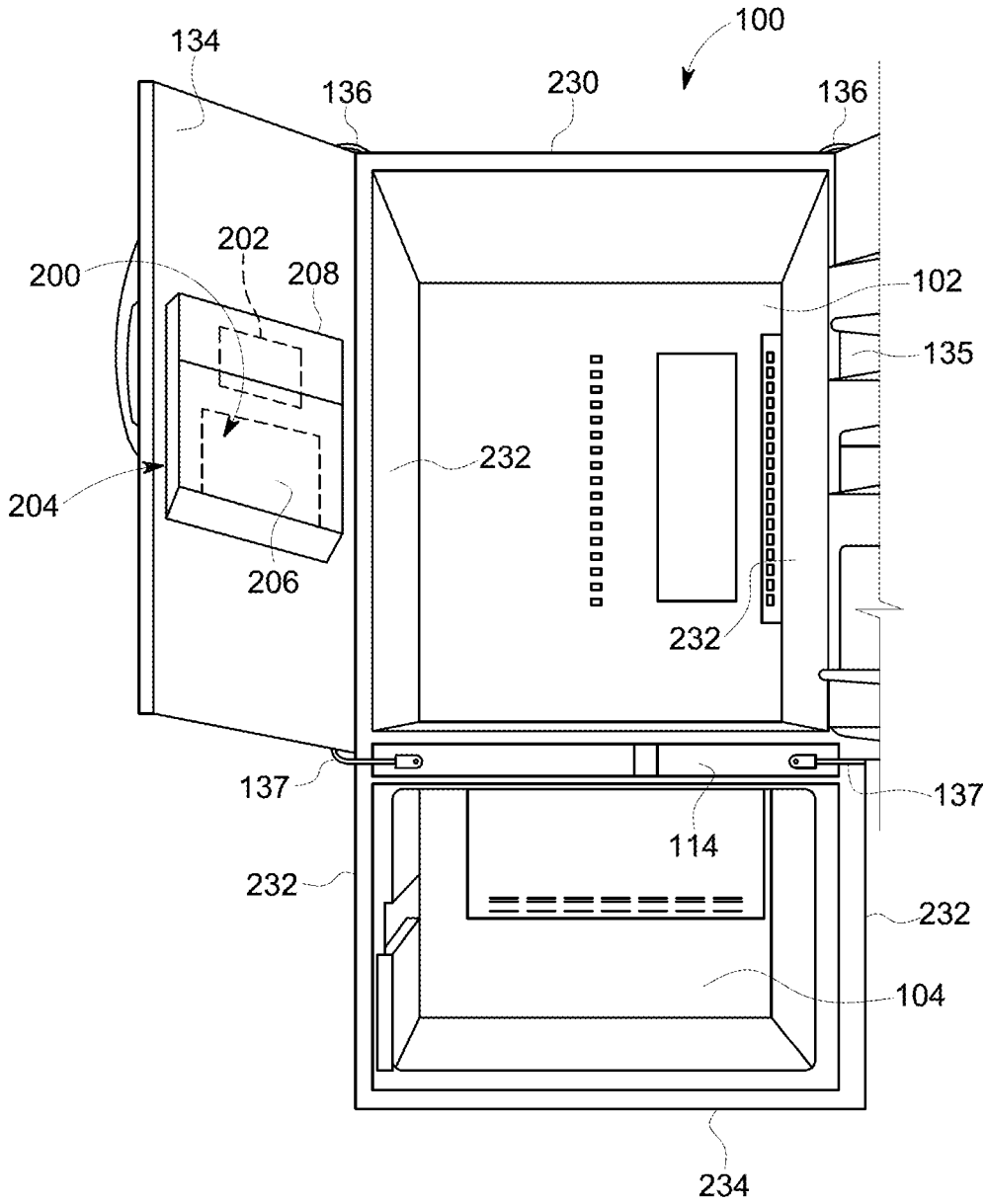
FIG. 2 is a simplified, perspective view of the refrigerator of FIG. 1 with the access doors of the fresh food compartment being in an open position and the drawer for the freezer compartment being removed for clarity.

FIG. 1 and FIG. 2 illustrate an exemplary refrigerator 100 which includes a fresh food compartment 102 and a freezer compartment 104. The refrigerator 100 is coolable by a conventional vapor-compression temperature control circuit. Although the refrigerator 100 is shown as the "bottom freezer" type, the teaching of the description set forth below is applicable to other types of refrigeration appliances, including but not limited to, side-by-side refrigerators. The present invention is therefore not intended to be limited to any particular type or configuration of a refrigerator.

The freezer compartment 104 and the fresh food compartment 102 are arranged in a bottom mount configuration where the freezer compartment 104 is disposed or arranged beneath or below the fresh food compartment 102. The fresh food compartment 102 is shown with French doors 134 and 135. However, a single access door can be used instead of the French doors 134, 135. The freezer compartment 104 is closed by a drawer or an access door 132.

The fresh food compartment 102 and the freezer compartment 104 are contained within a main body including an outer case 106. The outer case 106 can be formed by folding a sheet of a suitable material, such as pre-painted steel, into, for example, an inverted U-shape (or panelized case designs, etc.) to form a top 230 and two sidewalls 232 of the outer case 106. A mullion 114, best shown in FIG. 2, which is for example formed of an extruded ABS material, connects the two sidewalls 232 to each other and separates the fresh food compartment 102 from the freezer compartment 104. The outer case 106 also has a bottom 234, which connects the two sidewalls 232 to each other at the bottom edges thereof, and a back (not shown). As is known in the art, a thermally insulating liner is affixed to the outer case 106.

The access door 132 and the French doors 134, 135 close access openings to the freezer compartment 104 and the fresh food compartment 102, respectively.

Each French door 134, 135 is mounted to the main body by a top hinge 136 and a corresponding bottom hinge 137, thereby being rotatable about its outer vertical edge between an open position for accessing the respective part of the fresh food compartment 102, as shown in FIG. 2, and a closed position for closing the respective part of the fresh food compartment 102, as shown in FIG. 1.

Similarly, when an access door 132 is used for the freezer compartment 104, it is rotatably attached to the main body in a known fashion. When a drawer is used for the freezer compartment, it is slidably received in the cavity defined by the sidewalls 232, the mullion 114 and the bottom 234 in a known fashion.

As illustrated in FIG. 2, an ice making assembly 200 is mounted on the interior surface of the access door 134 of the fresh food compartment 102 (of course, the ice making assembly 200 can be mounted on the access door 135 instead). As also detailed herein, one or more embodiments of the invention can include separate configurations of an ice making assembly and/or ice/water dispenser. The ice making assembly 200 includes a thermally insulated ice compartment 204 mounted or formed on the access door 134, and an icemaker 202 disposed in the ice compartment 204 (alternatively, the icemaker 202 may be disposed in the freezer compartment 104 and connected to or in communication with the ice compartment 204 through a channel). Water is provided to ice molds of the icemaker 202 through a water supply conduit (not shown) extending from the main body of the refrigerator to the icemaker 202, and then is frozen into ice cubes. Then the ice cubes are usually discharged from the icemaker 202 and stored in an ice storage bin 206 until needed by a user. The ice storage bin 206 is disposed in the ice compartment 204, below the icemaker 202. The ice cubes may be withdrawn by accessing the ice compartment 204 through an access door 208 which faces the fresh food compartment 102 when the access door 134 is closed. However, the ice cubes are typically withdrawn by using an ice dispenser (as described herein) installed in the access door 134 through an opening 203 (shown in FIG. 1) formed on the exterior surface of the French door 134. The opening 203 faces away from the fresh food compartment 102 when the access door 134 is closed and is formed at a height facilitating convenient access to the ice. These are known in the art and therefore will not be discussed in detail here.

It will thus be appreciated that ice making assemblies in accordance with one or more embodiments of the invention can be positioned in a variety of locations, which may be similar to the positions of ice making assemblies on current refrigerators. These include, for example, the top corner of the freezer compartment, within the fresh food or freezer compartment doors, and so on. The footprint of ice making assemblies in accordance with one or more embodiments of the invention can, in at least some instances, be similar to those of current ice makers. A condenser (not shown) should be in an environment with a temperature sufficiently low to freeze water into ice at ambient pressure, such as the ambient air in the freezer compartment or separate ice making region.

Many alternative forms of ice mold bodies are possible, forming, for example, cubes or other conventional or novel ice shapes.

As described herein, one or more embodiments of the invention include techniques and apparatuses in connection with a refrigerator dispenser recess integrated with the door material to form a seamless dispenser (that is, an ice and/or water dispenser).

The door material of the refrigerator is formed to produce the dispenser recess wall surface of the refrigerator. The apparatus detailed herein provides a seamless and/or trim-less look for the refrigerator (and, specifically, to the dispenser).

In one or more embodiments of the invention, a portion of the outer door material of the refrigerator is formed into the shape of a dispenser recess. For example, in one or more embodiments of the invention, a portion of the door material is pushed or drawn inwardly from the primary door surface and a portion of the door material is drawn outwardly from the primary door surface. The appearance surface of the dispenser recess is formed from the door material, and a structural support is placed behind this area to provide functions as further described herein.

As detailed herein, one or more embodiments of the invention provide a new dispenser design in which the door material itself becomes integral to the dispenser, meaning that there is no longer a dispenser recess that forms the back wall as a separate piece. The door material itself becomes the recess back wall. This design, in accordance with one or more embodiments of the invention, is referred to herein as the "push-pull" design. One or more embodiments of the invention can include a top portion of the design that forms on the outer door material, and it is formed out while the dispenser portion pushes in. As such, the two pieces are pulled apart, and the ice and water services are provided therethrough. Also, one or more embodiments of the invention can include a bottom portion of the design that forms on the outer door material, and is formed out while the dispenser portion pushes in. As such, the two pieces are pulled apart, and a recess tray is provided therethrough.

As detailed herein, the design described in connection with one or more embodiments of the invention provide a unique appearance as well as eliminates parts and cracks and portions that are traditionally difficult to clean.

In contrast to one or more embodiments of the invention, existing approaches include seams and/or breaks in the appearance and breaks where dirt and material can collect. An apparatus such as detailed herein, in comparison, includes a sleek appearance and, when a user wants to clean the back of the dispenser recess area, the user can easily clean it off with a cloth because it is all one continuous piece with the door material.

The outer door material can be formed through forming operations to create the dispenser recess area. The design can also include a support structure that is located behind the recess and is used to route wires for the dispenser panel, as well as fit additional features (such as, for example, a tray on the bottom of the door, an ice chute and ice components to allow ice to pass through, etc.).

As detailed herein, functions of the structural recess can include, for example, foam sealing at openings, structural support to maintain the push/pull dimensions, an actuator pad mounting structure, an ice moving (funnel) support structure, a duct door mechanical support structure, appearance fascia support, electronics frame/electronic human machine interface (HMI) support, etc.

From the primary plane of the door, the door material is formed or molded to construct features that "pull" and "push" from the primary surface. This creates space for dispensing ice and water to a consumer/user.

Additionally, as noted, one or more embodiments of the invention include a support structure that attaches behind the outer door material. The support structure is used to isolate door foam and contain it inside. A gasket, foam, and/or adhesive can be used to perform this function. Further, the support structure is also used to control and/or lock the outer door material in the proper position during the foaming process.

Additionally, the support structure can contain many features to support the ice and water supply. For example, the support structure can include clips for routing tubing and wiring, a heater around the ice chute interface, an attachment point for an ice funnel, a mounting feature for an ice door and an ice door motor actuator, as well as a mounting feature for an external control feature.

As also described herein, the door material can be, by way of example, formed steel, molded plastic or a composite (such as, for example, fiberglass, carbon fiber, etc.).

Figure 3:
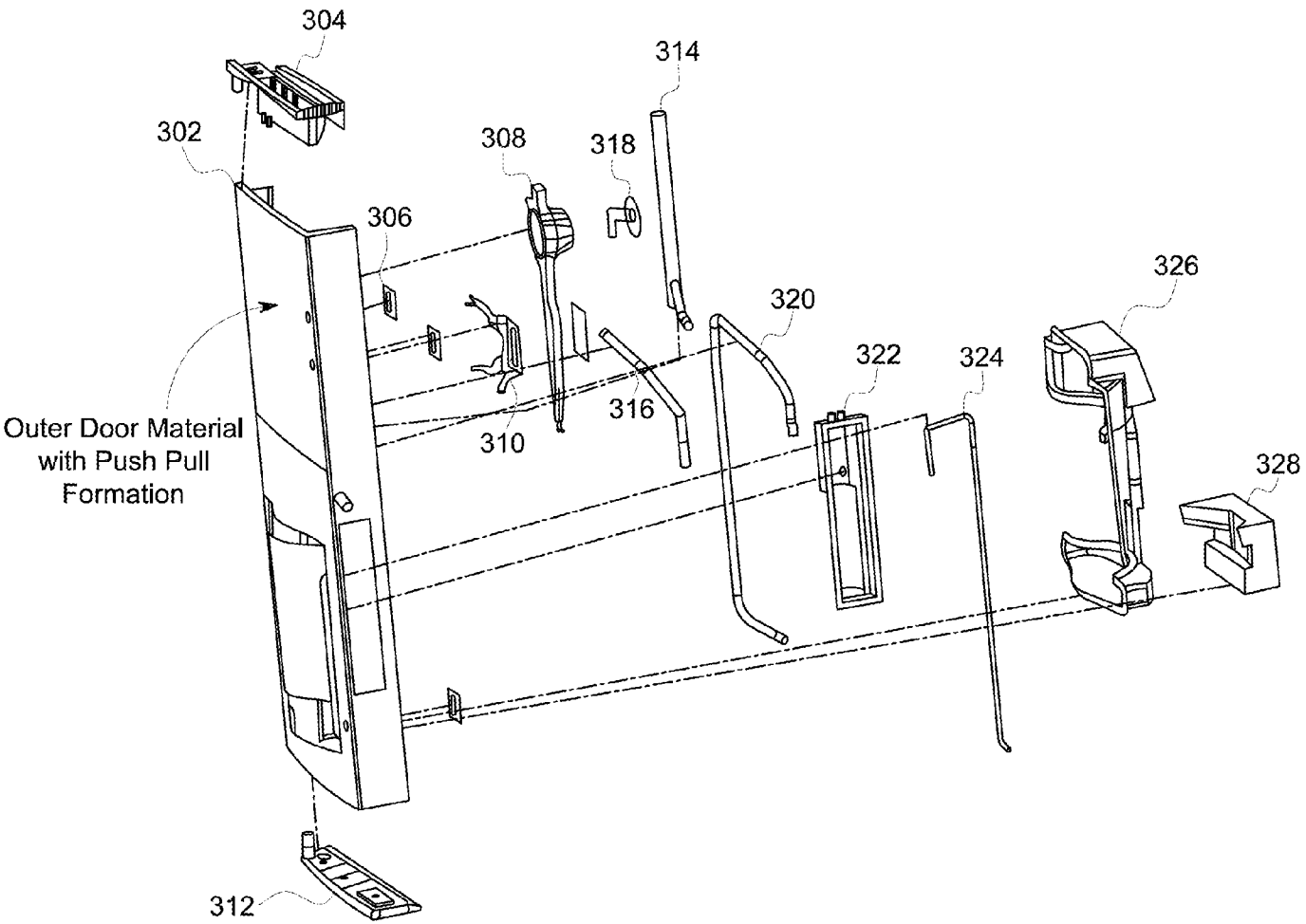
FIG. 3 presents an exploded view of an example outer door, in accordance with a non-limiting exemplary embodiment of the invention.

With reference now to FIG. 3, an example refrigerator outer door (exploded view) is depicted. By way of illustration, FIG. 3 depicts a bowed outer door 302, a door top cap 304, a door stop anchor screw 306, a locator tube spine 308, a locator electrical component 310, and a door bottom cap 312. FIG. 3 also depicts conduit fluid-in components 314 and 316, a fill tube component 318, an upper conduit filter-out component 320, a water filter housing 322, a formed dispenser tube 324, a push-pull recess support structure component 326 and a water valve junction box 328.

As illustrated in FIG. 3, the door material 302 is used to form the dispenser recess area. The support structure is placed behind this area to hold the features of the exterior shape. As illustrated in FIG. 3, an aspect of the invention includes forming steel outwardly from the primary face/surface of the door (that is, "pulling") to form locations for the controls and ice ejection (at the top) of the recess, and also to form locations for the drip tray (at the bottom) of the recess.

Figure 4:
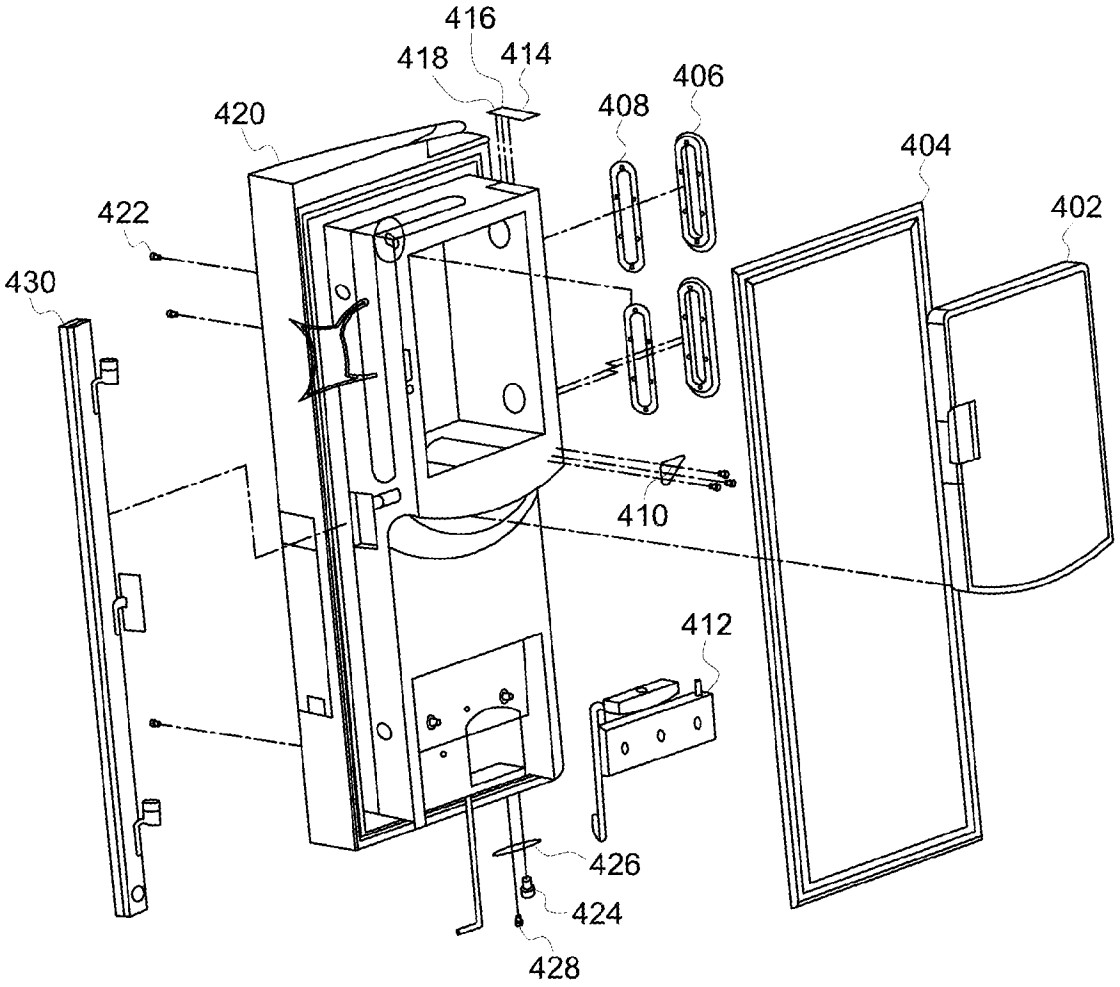
FIG. 4 presents an exploded view of an example inner door, in accordance with a non-limiting exemplary embodiment of the invention.

FIG. 4 presents an exploded view of an example inner door, in accordance with a non-limiting exemplary embodiment of the invention. By way of illustration, FIG. 4 depicts an ice box door 402, a French gasket 404, a gasket port 406, a collar port 408, an ice box door bottom hinge 410, a cold water tank 412, an ice box door top hinge 414 and ice box top hinge screws 416 and 418. FIG. 4 also depicts an inner door component 420, a handle fastener 422, door stop components 424 and 426, a timble screw 428 and an articulation mullion 430.

Figure 5:
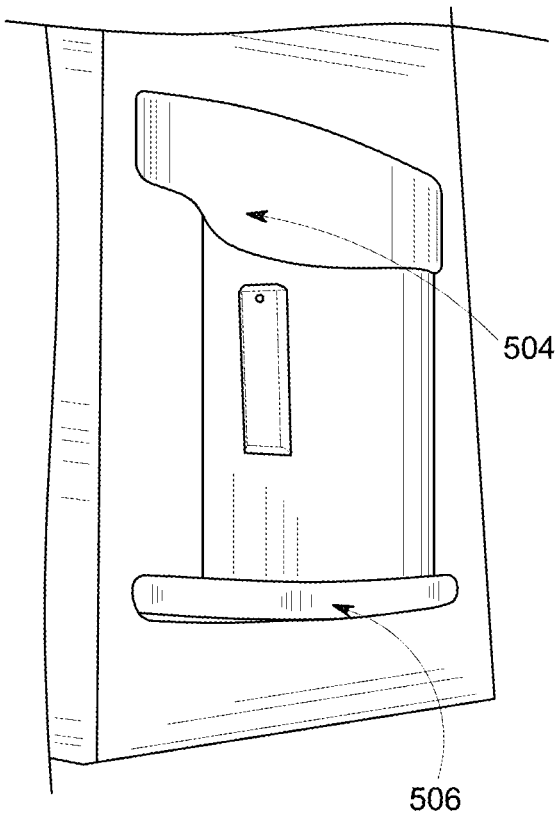
FIG. 5 presents pull and push features for ice and water service, in accordance with a non-limiting exemplary embodiment of the invention.

FIG. 5 presents pull and push features for ice and water service, in accordance with a non-limiting exemplary embodiment of the invention. By way of illustration, FIG. 5 depicts pull areas 504 of the door, wherein the door material is formed outward from the primary door plane and a recess. Also, FIG. 5 depicts a push area 506 of the door, wherein the door material is formed inward from the primary door plane. Pull and push features allow for ice and water service to pass through the door and create a recess area. The lower push-pull area (for example, the drip tray) allows for a larger ledge to support containers for dispensing water and ice into. Pulling the material allows for a larger ledge to be created.

Figure 6:
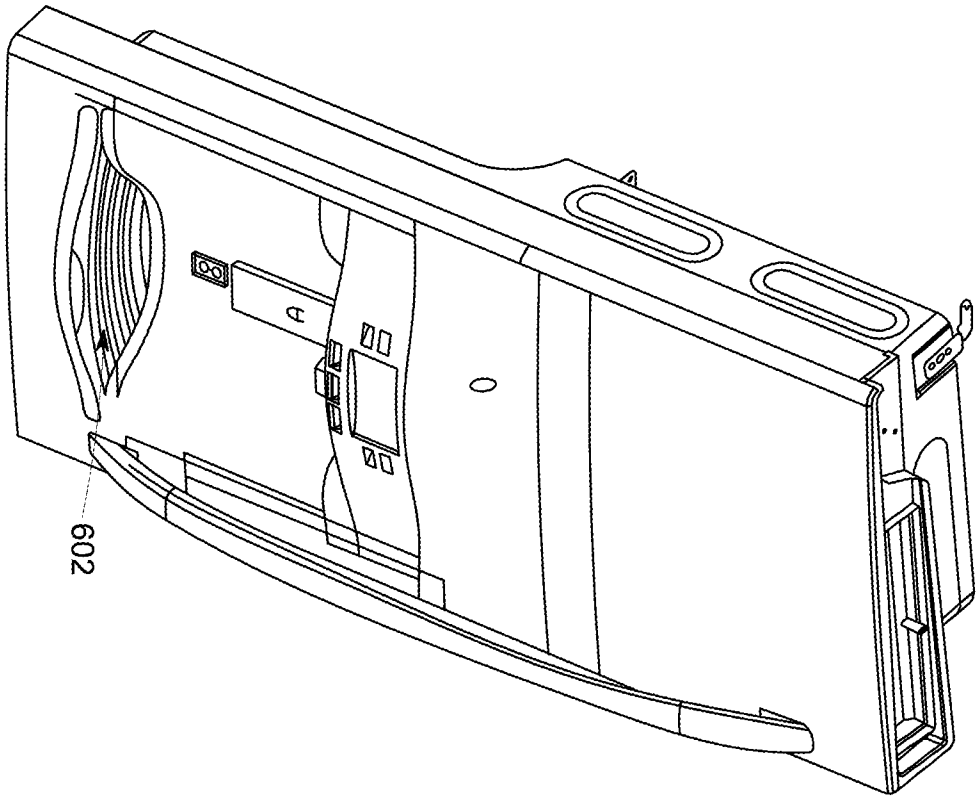
FIG. 6 highlights an example recess tray, in accordance with a non-limiting exemplary embodiment of the invention.

Additionally, FIG. 6 highlights an example recess tray 602, in accordance with a non-limiting exemplary embodiment of the invention. As with the push area 506 depicted in FIG. 5, recess tray 602 represents a feature that can be implemented in one or more embodiments of the invention.

Figure 7A:
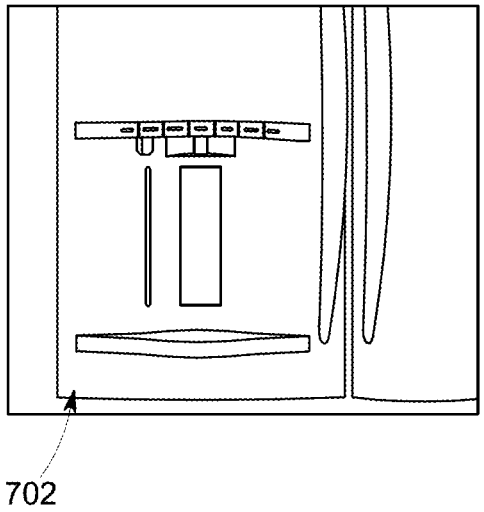
FIGS. 7A-C present exterior views of an example dispenser, in accordancewith a non-limiting exemplary embodiment of the invention.
Figure 7B:
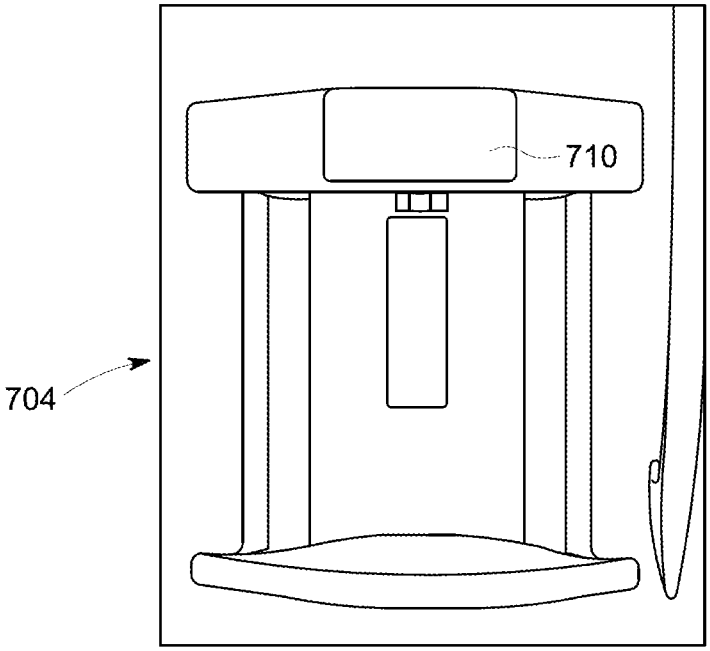
Figure 7C:
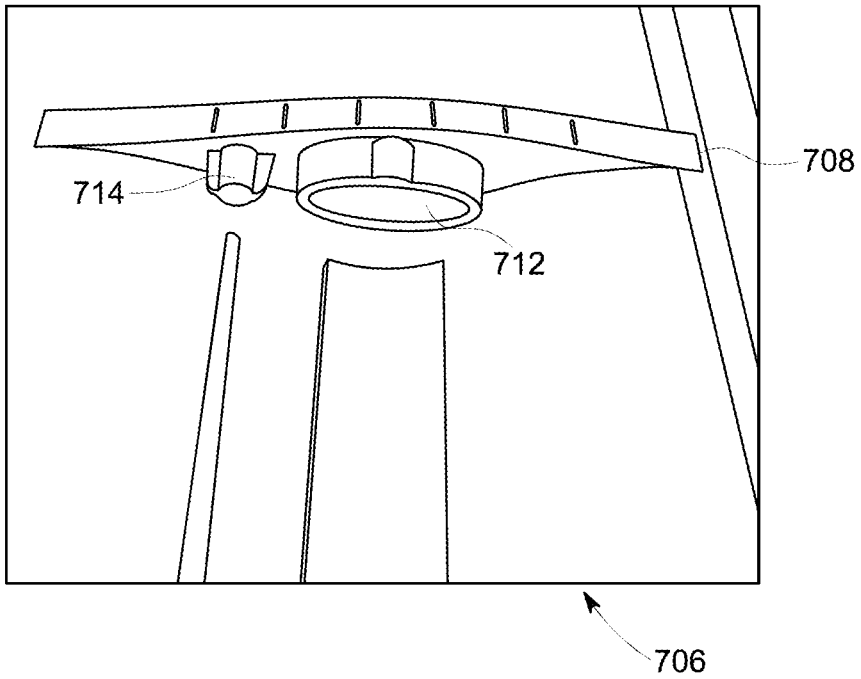

FIGS. 7A-C present respective exterior views 702, 704 and 706 of an example dispenser, in accordance with a non-limiting exemplary embodiment of the invention. As illustrated by FIGS. 7A-C, example dispensers can additionally include a control panel 708 and/or a user interface with controls 710, as well as an ice dispenser 712 and a water dispenser 714.

Figure 8:
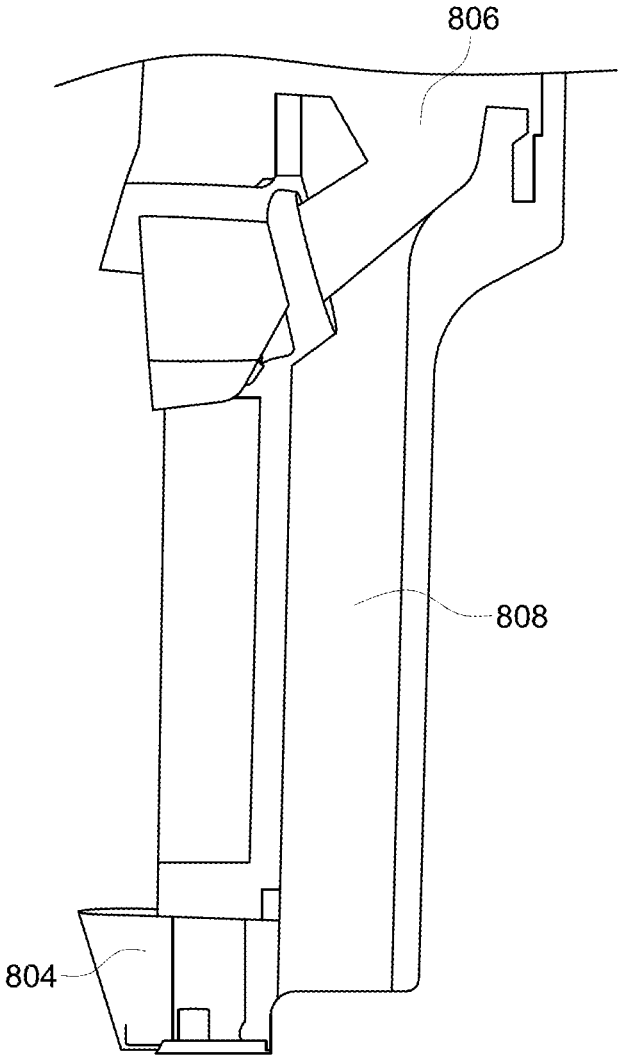
FIG. 8 presents a side view of an example dispenser, in accordance with a non-limiting exemplary embodiment of the invention.

FIG. 8 presents a side view of an example dispenser, in accordance with a non-limiting exemplary embodiment of the invention. By way of illustration, FIG. 8 depicts an outer door 804, an ice chute 806 and an inner door liner 808.

Figure 9A:
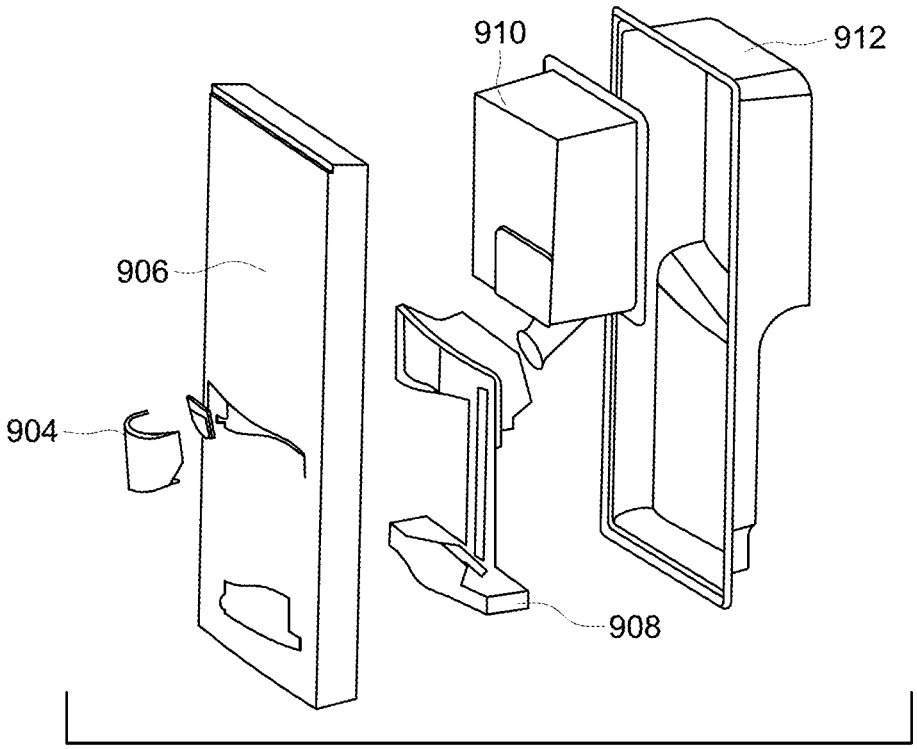
FIGS. 9A-C present multiple views of dispenser components and interface, in accordance with a non-limiting exemplary embodiment of the invention.
Figure 9B:
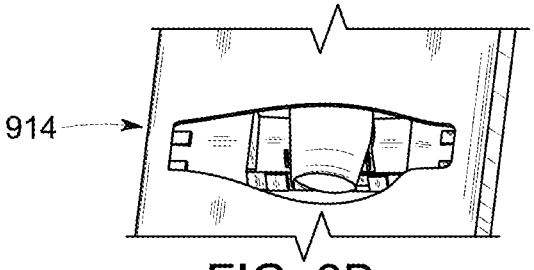
Figure 9C:
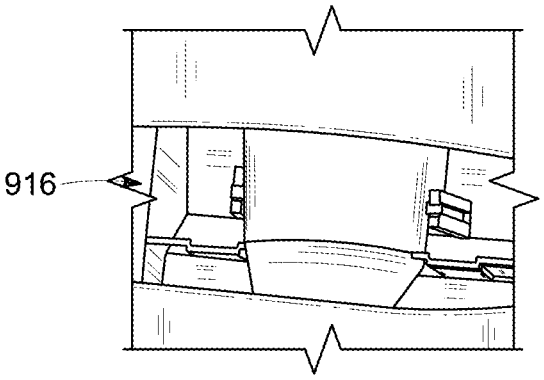

FIGS. 9A-C present multiple views of dispenser components and interface, in accordance with a non-limiting exemplary embodiment of the invention. By way of illustration, FIGS. 9A-C depicts a push-pull ice chute component 904, an outer door 906, a structural support 908, an ice box 910, inner door component 912 and separate images of the push-pull recess 914 and 916.

Figure 10:
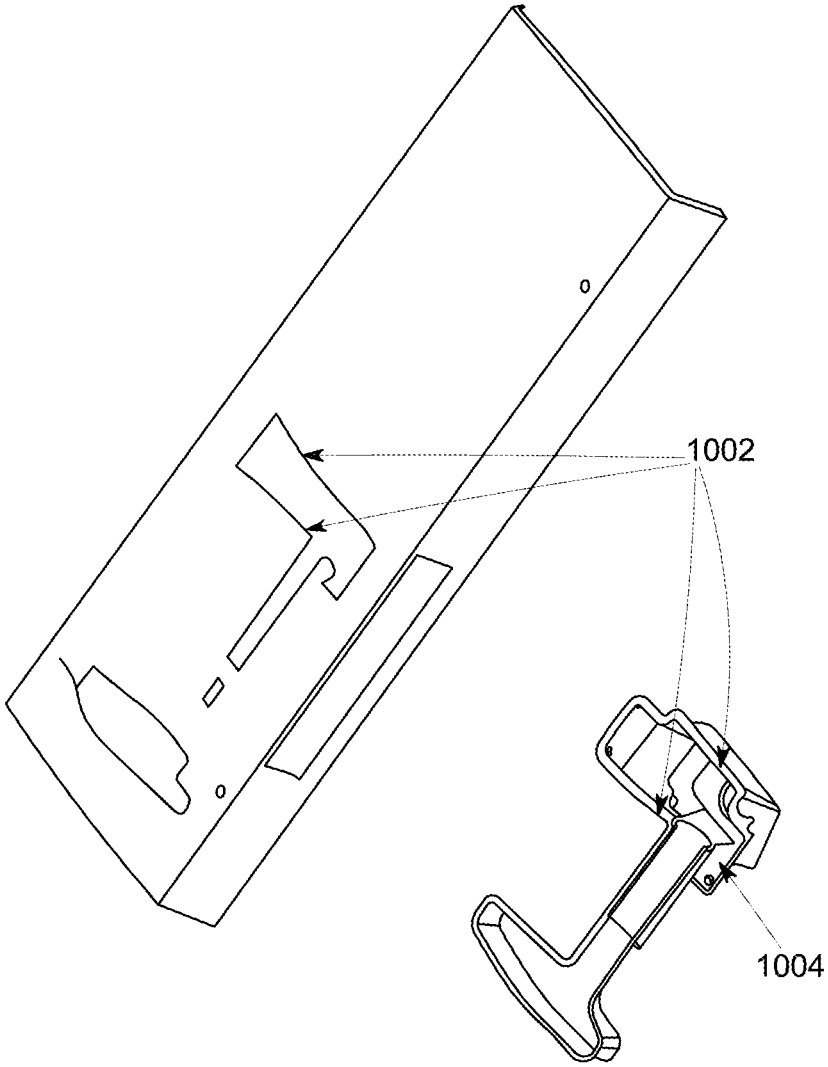
FIG. 10 presents features of a push-pull recess, in accordance with a non-limiting exemplary embodiment of the invention.

Additionally, features of a push-pull recess, in accordance with one or more embodiments of the invention, are depicted further in FIG. 10, FIGS. 11A-B, and FIGS. 12A-C. By way of illustration, FIG. 10 depicts structural support 1002 to the push-pull feature on an outer door, and component 1004, which can include double-sided tape or other adhesive, between the structural support and the outer door to provide a good foam sealing. As depicted, recess mating surfaces give structural support for push and pull surfaces on the outer door.

Figure 11A:
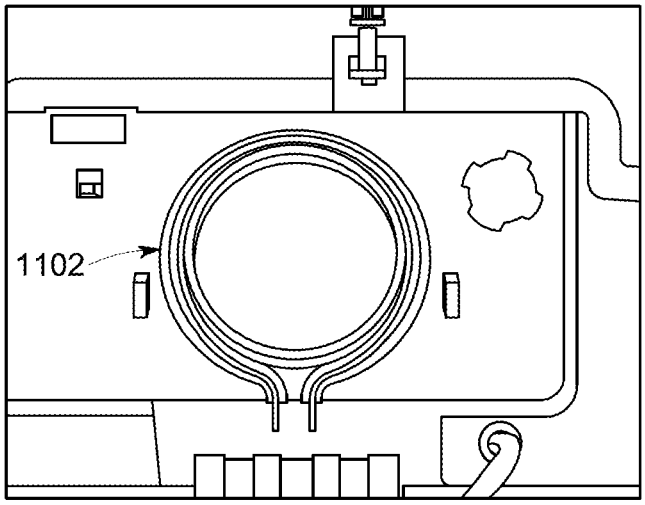
FIGS. 11A-B present features of a push-pull recess, in accordance with a non-limiting exemplary embodiment of the invention.
Figure 11B:
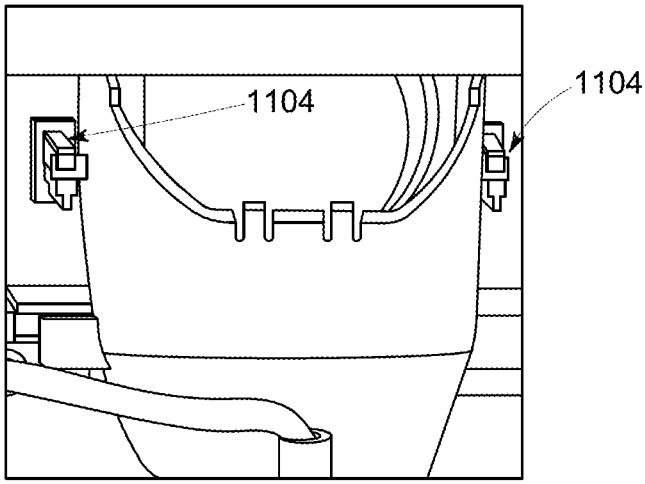

FIG. 11A depicts a heater 1102 around the collar (ice chute opening)/integrating heater in recess. Most existing heaters are a rectangular shape covering the back surface, but the circular heater design depicted in FIG. 11A (in connection with one or more embodiments of the invention) helps in reducing heating surface area and concentrates on the area of interest. FIG. 11B depicts a snap design 1104 for funnel assembly. With respect to the snap design, in one or more embodiments of the invention, protrusions on a funnel engage with a snap feature to retain the funnel in position without the use of fasteners, allowing for ease of assembly and removal of the funnel as needed.

Most existing designs use screws to secure a funnel to a recess, which consumes more operator time. A snap design, such as detailed in connection with one or more embodiments of the invention, makes assembly of funnel to the recess easier, reduces operator time, and is easier to service. A funnel slides on the "C" channel on the recesses and is locked in position by snaps during assembly. The funnel is held rigid in assembly by bottom support and snaps.

Figure 12C:
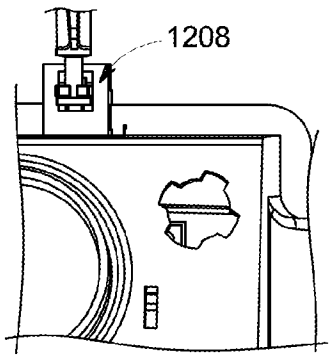
FIGS. 12A-C present features of a push-pull recess, in accordance with a non-limiting exemplary embodiment of the invention.
Figure 12B:
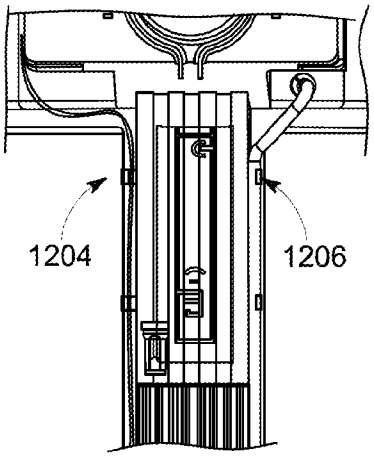
Figure 12A:
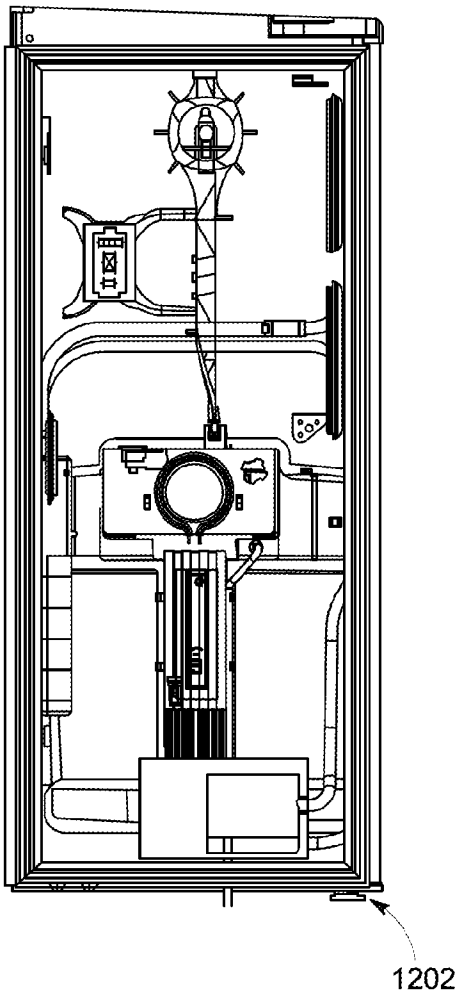

Additionally, FIG. 12A depicts an overview of assembly operations 1202, and more specifically, FIG. 12B depicts a close-up view of a clip design for harness routing 1204 and a clip design for tube routing 1206. FIG. 12C depicts a close-up view of a snap design for fill tube/harness housing assembly 1208. FIGS. 12A-C depict features that can be incorporated into a structural support to facilitate assembly operations. These include clips for dressing wiring harness (as illustrated by 1204), for assembling water tubes (as illustrated by 1206), as well as snaps for features that penetrate the structural support and pass through to front of unit (as illustrated by 1208).

The use of clips makes it easier to assemble water tubes on the recess. The tubes around the recess are held firmly in place by pushing them on the clips. In general, wire harnesses are routed and held in place by using masking tape, which is cumbersome. In one or more embodiments of the invention, the snaps on the recess help assembly of harness easier and hold them firmly in position.

Figure 13A:
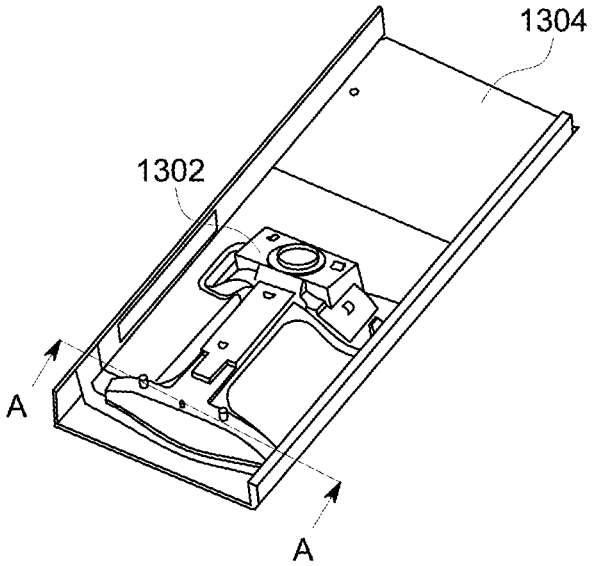
FIGS. 13A-D presents a recess on a push-pull outer door, in accordance with anon-limiting exemplary embodiment of the invention.
Figure 13B:
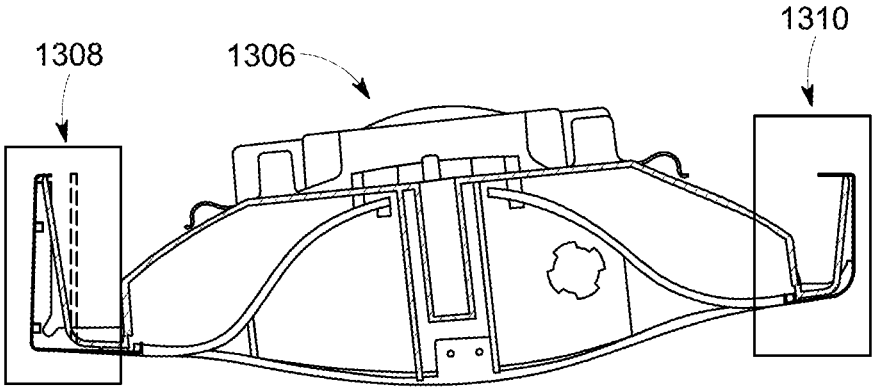
Figure 13C:
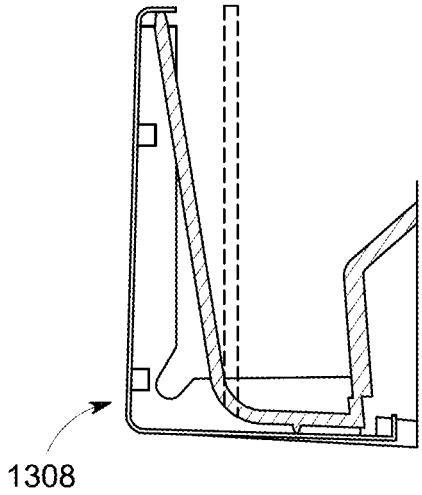
Figure 13D:
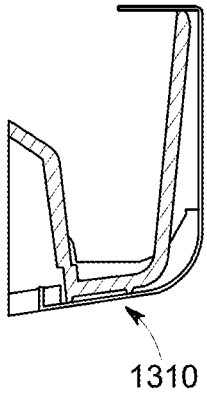

FIGS. 13A-D present a recess on a push-pull outer door, in accordance with a non-limiting exemplary embodiment of the invention. By way of illustration, FIG. 13A depicts a recess structure 1302 located on a push-pull outer door 1304. The recess structure 1302 is assembled to the outer door via a screw and bottom supports. The section of the recess structure identified in the figure as AA is highlighted in image 1306 in FIG. 13B, and support features 1308 and 1310 of the recess are additionally highlighted and enlarged in FIGS. 13C and 13D, respectively. Further, as depicted in FIGS. 13A-D, support features 1308 and 1310 are flexible so as to provide versatility while assembling, and the support features also assist in preventing the recess from moving up.

Figure 14:
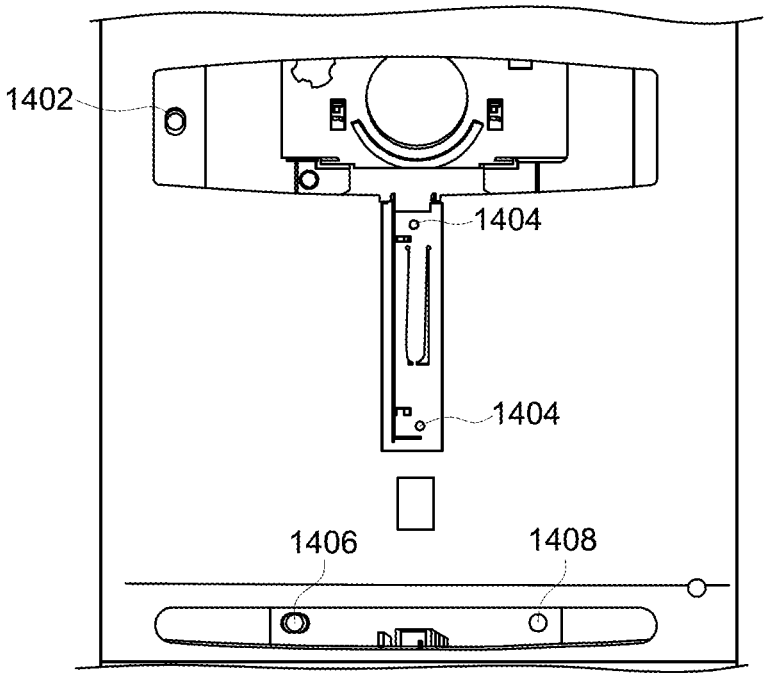
FIG. 14 presents a recess on a push-pull outer door, in accordance with a non-limiting exemplary embodiment of the invention.

Additionally, FIG. 14 presents a recess on a push-pull outer door, in accordance with a non-limiting exemplary embodiment of the invention. By way of illustration, FIG. 14 depicts pins used in locating and fixing the recess to the outer door during assembly. As depicted, FIG. 14 shows a floating vertical pin 1402, screws 1404, a floating horizontal pin 1406 and a fixed pin 1408.

Figure 15:
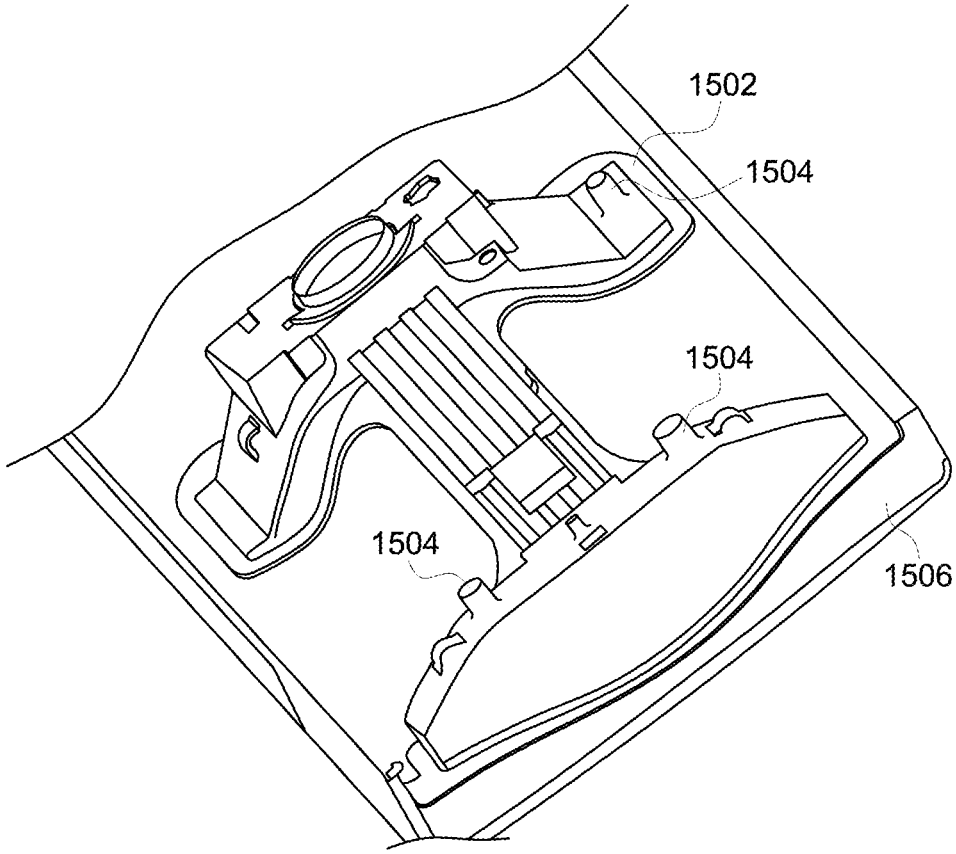
FIG. 15 presents a recess on a push-pull outer door, in accordance with a non-limiting exemplary embodiment of the invention.
Figure 16B:
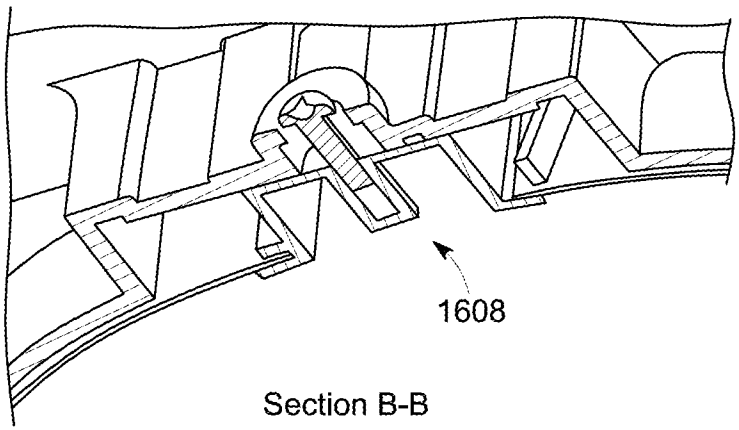
FIGS. 16A-B present a recess on a push-pull outer door, in accordance with a non-limiting exemplary embodiment of the invention.
Figure 16A:
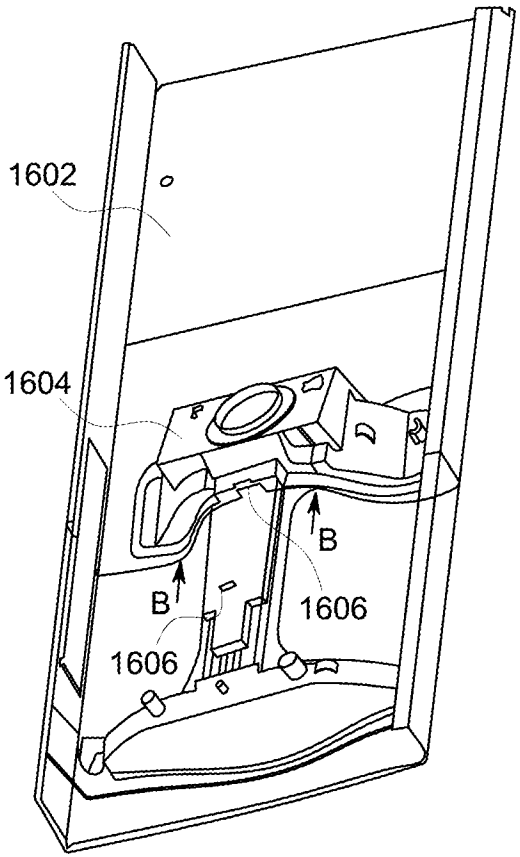

FIG. 15 presents another view of the recess on a push-pull outer door, in accordance with a non-limiting exemplary embodiment of the invention. By way of illustration, FIG. 15 depicts the recess 1502, the outer door 1506, and locating pins 1504 on the recess structure. FIGS. 16A-B present yet another view of the recess on a push-pull outer door, in accordance with a non-limiting exemplary embodiment of the invention. By way of illustration, FIG. 16A depicts the outer door 1602, the recess 1604, and two screws 1606 that hold a paddle to the recess and support the push-pull geometry of the outer door. One of the sections of the recess that includes a screw 1606 (further identified as section BB) is further highlighted in image 1608 in FIG. 16B.

One advantage that may be realized in the practice of some embodiments of the described systems and techniques is facilitating ease of cleaning the components in question. Another advantage that may be realized in the practice of some embodiments of the described systems and techniques is part reduction by not wasting door material, thereby resulting in reduced overall system cost.

An example refrigerator can also include a door hinged to the body and permitting access to the at least one cooled compartment, wherein the door includes an inner door material and an outer door material and wherein a portion of the outer door material of the refrigerator is formed into a shape of a dispenser recess. Accordingly, a portion of the outer door material can be drawn inwardly from a primary door surface and a portion of the outer door material can be drawn outwardly from the primary door surface. The refrigerator additionally includes a support structure situated behind the dispenser recess of the outer door material and in front of the inner door material, and wherein the support structure facilitates implementation of one or more dispenser features. The support structure also includes one or more mounting components for fixing the support structure to the outer door (see, for example, FIGS. 13-16). Further, the refrigerator can include a mold body with at least one cavity configured and dimensioned to receive water to be frozen into ice, the mold body being in thermal communication with the at least one cooled compartment, and an ice discharge mechanism, mounted to the body of the refrigerator, and configured to cause the ice to be removed from the at least one cavity and output to the dispenser recess.

As additionally noted herein, the support structure in such an example refrigerator can include, for example, clips for routing tubing and wiring, an attachment point for an ice funnel, a mounting feature for an ice door, an ice door motor actuator, a mounting feature for an external control feature, and/or a heater around an ice chute opening, wherein the heater has a circular heater design. The support structure can also include one or more mounting components for fixing the recess structure to the outer door (as depicted, for example, in FIGS. 13-16).

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a refrigerator door, comprising an inner door material and an outer door material;

wherein a portion of the outer door material of the refrigerator door is formed into a shape of a dispenser recess; and a support structure, wherein the support structure is situated behind the dispenser recess of the outer door material and in front of the inner door material, and wherein the support structure facilitates implementation of one or more dispenser features;

wherein a first portion of the outer door material is drawn inwardly from a primary door surface defining a recess with respect to the primary door surface and a second portion of the outer door material is drawn outwardly from the primary door surface defining a protrusion with respect to the primary door surface, and wherein the first portion of the outer door material forms a back wall of the dispenser recess and the second portion of the outer door material comprises a top portion and a bottom portion, the top portion forming at least one of a user input control location, an ice ejection location and a dispenser location and the bottom portion forming a location for at least a portion of a recess tray.

2. The apparatus of claim 1, wherein the outer door material is made of steel.

3. The apparatus of claim 1, wherein the outer door material is made of one of plastic and a composite.

4. The apparatus of claim 1, wherein the support structure comprises one or more clips for routing tubing and wiring.

5. The apparatus of claim 1, wherein the support structure comprises an attachment point for an ice funnel.

6. The apparatus of claim 1, wherein the support structure comprises:

a mounting feature for an external control feature; and a heater around an ice chute opening, wherein the heater comprises a circular heater design.

7. The apparatus of claim 1, further comprising an ice funnel.

8. The apparatus of claim 1, further comprising a water dispenser.

9. The apparatus of claim 1, further comprising the recess tray.

10. The apparatus of claim 1, wherein the support structure comprises one or more mounting components.

11. An apparatus comprising:

a refrigerator door, comprising an inner door material and an outer door material;

wherein a portion of the outer door material of the refrigerator door is formed into a shape of a dispenser recess; and a support structure, wherein the support structure is situated behind the dispenser recess of the outer door material and in front of the inner door material, and wherein the support structure facilitates implementation of one or more dispenser features, wherein the support structure is bowed to facilitate a tight tit between ends of the structural support compressed to the outer door material.

12. The apparatus of claim 1, further comprising a user interface with dispenser controls.

13. A refrigerator comprising:

a body defining at least one cooled compartment;

a door hinged to the body and permitting access to the at least one cooled compartment, wherein the door comprises an inner door material and an outer door material;

wherein a portion of the outer door material of the refrigerator door is formed into a shape of a dispenser recess;

wherein a first portion of the outer door material is drawn inwardly from a primary door surface defining a recess with respect to the primary door surface and a second portion of the outer door material is drawn outwardly from the primary door surface defining a protrusion with respect to the primary door surface;

a support structure, wherein the support structure is situated behind the dispenser recess of the outer door material and in front of the inner door material, and wherein the support structure facilitates implementation of one or more dispenser features; and an ice discharge mechanism, mounted to the body of the refrigerator, and configured to cause ice to be removed from at least one cavity and output to the dispenser recess, wherein the first portion of the outer door material forms a back wall of the dispenser recess and the second portion of the outer door material comprises a top portion and a bottom portion, the top portion forming at least one of a user input control location, an ice ejection location and a dispenser location and the bottom portion forming a location for at least a portion of a recess tray.

14. The refrigerator of claim 13, wherein the support structure comprises an attachment point for an ice funnel.

15. The refrigerator of claim 13, further comprising a water dispenser.

16. The refrigerator of claim 13, further comprising a recess tray, wherein a portion of the recess tray is able to be extended.

17. The refrigerator of claim 16, wherein the support structure comprises one or more mounting components for fixing the support structure to the outer door material.

18. The refrigerator of claim 13, further comprising a user interface with dispenser controls.

19. The apparatus of claim 1, wherein the support structure is configured to maintain respective dimensions of the first portion of the outer door material and the second portion of the outer door material.

* * * * *